United States Patent [19]

Iten

[11] Patent Number: 4,785,935

[45] Date of Patent: Nov. 22, 1988

[54] RAZOR PACKAGING

[75] Inventor: Clemens A. Iten, Fisherville, Va.

[73] Assignee: American Safety Razor Company, Verona, Va.

[21] Appl. No.: 151,532

[22] Filed: Feb. 2, 1988

Related U.S. Application Data

[63] Continuation-in-part of Ser. No. 86,481, Aug. 18, 1987, Pat. No. 4,735,312.

[51] Int. Cl.[4] ..... B65D 73/00

[52] U.S. Cl. ..... 206/372; 206/349; 206/477; 206/479

[58] Field of Search ..... 206/352, 354, 208, 372, 206/349, 228, 477, 479, 480, 481, 483

[56] References Cited

U.S. PATENT DOCUMENTS

| | | | |
|---|---|---|---|
| D. 253,040 | 10/1979 | Fournier et al. . | |
| D. 255,327 | 6/1980 | Samsing . | |
| D. 257,327 | 10/1980 | Samsing . | |
| D. 262,095 | 12/1981 | Takahaski . | |
| D. 272,803 | 2/1984 | Richards . | |
| D. 275,737 | 10/1984 | Carey, Jr. et al. . | |
| D. 276,794 | 12/1984 | Richards . | |
| D. 276,893 | 12/1984 | Richards . | |
| 1,877,840 | 9/1932 | Frowenfeld | 206/479 |
| 2,535,229 | 12/1950 | Paolantonio | 206/479 X |
| 2,594,093 | 4/1952 | Thompson . | |
| 2,825,162 | 3/1958 | Flood . | |
| 2,884,150 | 4/1959 | Weichselbaum et al. . | |
| 3,464,545 | 9/1969 | Bailey | 206/478 |
| 3,802,987 | 4/1974 | Noll . | |
| 3,917,120 | 11/1975 | Larenz et al. . | |
| 4,000,832 | 1/1977 | Pentney . | |
| 4,024,950 | 5/1977 | Werth . | |
| 4,128,172 | 12/1978 | Joyce . | |
| 4,140,244 | 2/1979 | Clabby | 206/228 |
| 4,266,664 | 5/1981 | Dixon et al. . | |
| 4,309,821 | 1/1982 | Terry et al. | 206/372 X |
| 4,322,002 | 3/1982 | Iten . | |
| 4,432,452 | 2/1984 | Kelly . | |
| 4,445,610 | 5/1984 | Richards . | |
| 4,496,047 | 1/1985 | Gatley . | |
| 4,555,030 | 11/1985 | Byrne et al. . | |
| 4,564,108 | 1/1986 | Widlund et al. . | |
| 4,601,392 | 7/1986 | Althaus . | |
| 4,637,060 | 1/1987 | Ausnit . | |
| 4,664,733 | 5/1987 | Masago . | |
| 4,735,312 | 4/1988 | Iten | 206/372 |

FOREIGN PATENT DOCUMENTS

| | | | |
|---|---|---|---|
| 1111366 | 10/1955 | France | 206/372 |
| 299089 | 7/1932 | Italy | 206/479 |
| 398729 | 9/1933 | United Kingdom | 206/479 |
| 543036 | 2/1942 | United Kingdom | 206/479 |

*Primary Examiner*—William Price

*Attorney, Agent, or Firm*—Nixon & Vanderhye

[57] ABSTRACT

Razor packaging includes a plurality of razors having handles and heads nested in front-to-back serial relation adjacent one another, with threads being disposed over the top and bottom portions of the razor heads on opposite sides thereof and looped one with the other to preclude displacement of the razors relative to one another. An elongated edge of the head of the razor overlies an edge of the next adjacent serially connected razor whereby the razor heads are stepped relative to one another. The last razor is secured to a tag by stitching the threads extending from the group of razors into the tag. An aperture is provided in the tag such that the razor package can be disposed on a hook for hanging from a displayboard. In this manner, groups of razors are precluded from disconnection one with the other absent severing the threads by the ultimate end user.

17 Claims, 4 Drawing Sheets

FIG. 7
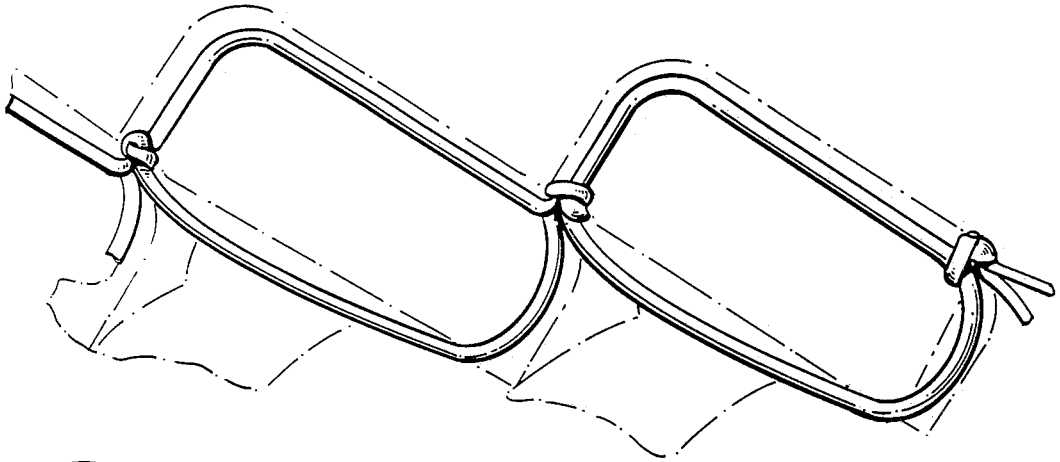
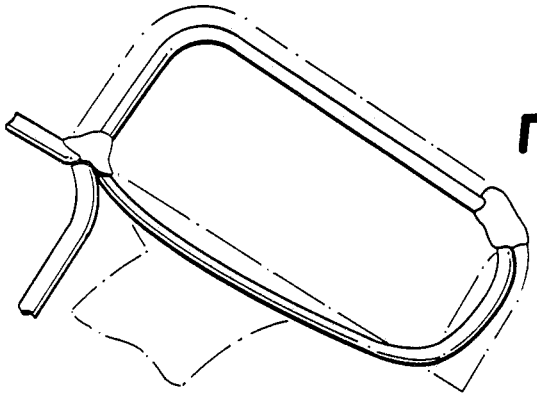
FIG. 8
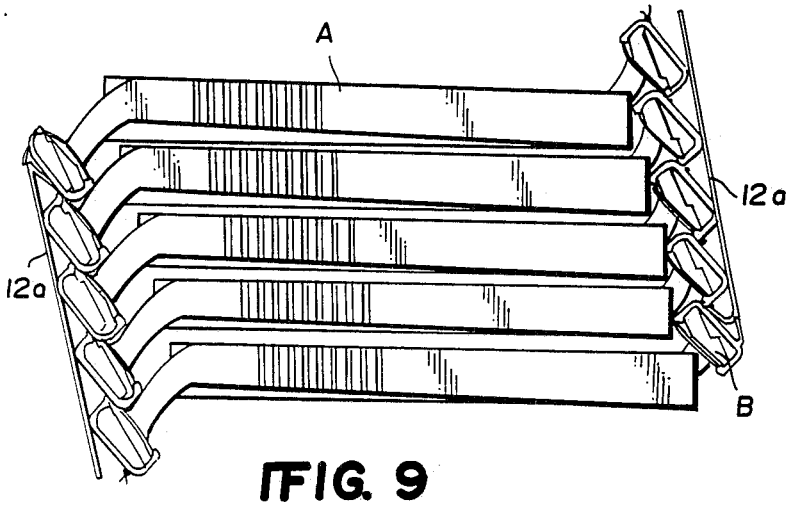
FIG. 9

RAZOR PACKAGING

RELATED APPLICATIONS

This application is a continuation-in-part of application Ser. No. 086,481, filed August 18, 1987, of common assignee herewith now U.S. Pat. No. 4,735,312.

BACKGROUND AND SUMMARY OF THE INVENTION

The present invention relates to packaging for razors and particularly relates to razor packaging wherein razors can be readily, easily and inexpensively maintained in a coherent group thereof for purposes of retail display.

Various types of packaging for razors have been proposed and constructed in the past. Because of the unique shape and configuration of razors, i.e., an elongated handle having an angled portion for connection to a razor head extending in a direction normal to the handle, packaging of razors has taken various forms. For example, in U.S. Pat. No. D. 272,803, there is disclosed a box-like assembly having an elongated slot. The heads of the razors are disposed in the box and the handles extend through the slot to depend from the box. In U.S. Pat. No. 4,601,392, there is provided a support plate for supporting the ends of the razor heads, by means of a strip integrally molded with the protective caps for the razor heads. Various other types of packaging for razors have been proposed. However, the unique shape of the razor presents particular problems in efforts to provide inexpensive packaging for razors which is readily and easily adapted for display in standard display racks.

According to the present invention, there is provided a unique packaging for razors whereby the razors can be readily, easily and inexpensively attached or secured one to the other and to a display tag in such manner that the razors are adapted for display from standard display racks as a coherent group thereof and which razors may not be separated one from the other or from the display tag absent cutting or otherwise severing the means securing the razors and tag each to the other. Thus, the razor package of the present invention may be displayed, for example, by attaching the tag to a hook on a standard display board with the plurality of razors attached to the tag dependent therefrom. The razors may be readily handled yet they are not separable one from the other or from the tag.

Additionally, each razor is normally provided with a protective cap over its head which is readily removable when the razor is to be used. In razor packaging, a problem sometimes arises because the cap may be inadvertently removed from the razor thereby exposing the razor blade and raising the potential for injury. For example, loose packaging of the razors may permit the caps to be knocked loose. The present invention provides the razor package in such manner that each cap is maintained in position secured on the razor head and is prevented from inadvertent removal from the head until the user separates the razors for ultimate use.

Accordingly, and in accordance with one aspect of the present invention. there is provided razor packaging comprising a plurality of razors, each of which has a razor head and a handle projecting from the head, a display tag, and means for connecting the razors one to the other and to the tag, including a thread stitched through the tag and disposed about the razor heads.

Preferably, the razor heads are serially connected one to the other by the thread. The tag is attached to an end razor in the serially arranged razors by a continuation of the thread, which is stitched through the tag.

Preferably, two threads are stitched through the tag at laterally spaced positions therealong. Each thread extends over a first or upper side of the razor heads (opposite from the handle) and a second thread portion extends along the underside of the razor heads. The first thread portionis looped about the second thread portion with the looped portion of each thread disposed between each of the adjacent razor heads. In this manner, the razor heads are captured by the thread portions between the looped portions. In so doing, the caps are also maintained in securement on the razor heads. It will also be appreciated that the tag may be printed with indicia identifying the manufacturer and the features of the razors and also that a plurality of razors may be readily and easily attached to the tag by a stitching operation.

In a further preferred form of razor packaging according to the present invention, an edge of one razor in the serially connected razors overlies an edge of the next adjacent serially connected razor. Preferably, the tag is connected to the first of the serially connected razors and the rear edge of each razor head beyond the first razor in a direction away from said tag lies above the forward edge of the preceding razor head whereby the razor heads lie in stepped relation one to the other. Consequently, the razors of the package may project forwardly at a sharper angle from the tag when hung from a display rack. This saves substantial space on the display rack in comparison with the previously described arrangement wherein the razor heads are linearly serially aligned one with the other. Also, in this stepped configuration, the package is substantially rectilinear and close to rectangular in cross-section, thereby facilitating grouping of the razor packages in a rectangular container.

Accordingly, in another aspect of the present invention there is provided an assemblage of razors comprising a plurality of razor packages, each of the razor packages including a plurality of razors, each having a razor head and a handle projecting from the head and a display tag, each razor package further including means for connecting the razors one to the other and to the tag comprised of a thread stitched through the tag and disposed about the razor heads, the handles of each package projecting to like sides of the heads of the package, first and second of the packages being disposed adjacent one another to form an assemblage thereof with the heads of the razors of the first and second packages lying at opposite ends of the assemblage and their respective handles extending therefrom in opposite directions toward the heads of the other package. Thus, each assemblage of the razor packages has a generally rectilinear configuration approximating a rectangular configuration. This facilitates packaging of the razors in a rectangular-shaped container.

Accordingly, it is a primary object of the present invention to provide novel and improved razor packaging which is readily, easily and inexpensively constructed to maintain a plurality of razors in a coherent group, readily adapted for display purposes and which minimizes or eliminates the potential for inadvertent removal of the cap from the razor head.

These and further objects and advantages of the present invention will become more apparent upon reference to the following specification, appended drawings and claims.

BRIEF DESCRIPTION OF THE DRAWING FIGURES

FIG. 7 is a view similar to FIG. 6 illustrating the thread disposed about each of the razor heads;

FIG. 8 is a view similar to FIG. 7 illustrating the thread arrangement;

FIG. 9 is a side elevational view of two razor packages disposed in side-by-side relation one to the other to form a generally rectilinear cross-sectional group of razor packages.

DETAILED DESCRIPTION OF THE DRAWING FIGURES

Reference will now be made in detail to the present preferred embodiment of the invention, an example of which is illustrated in the accompanying drawings.

Figure 1:
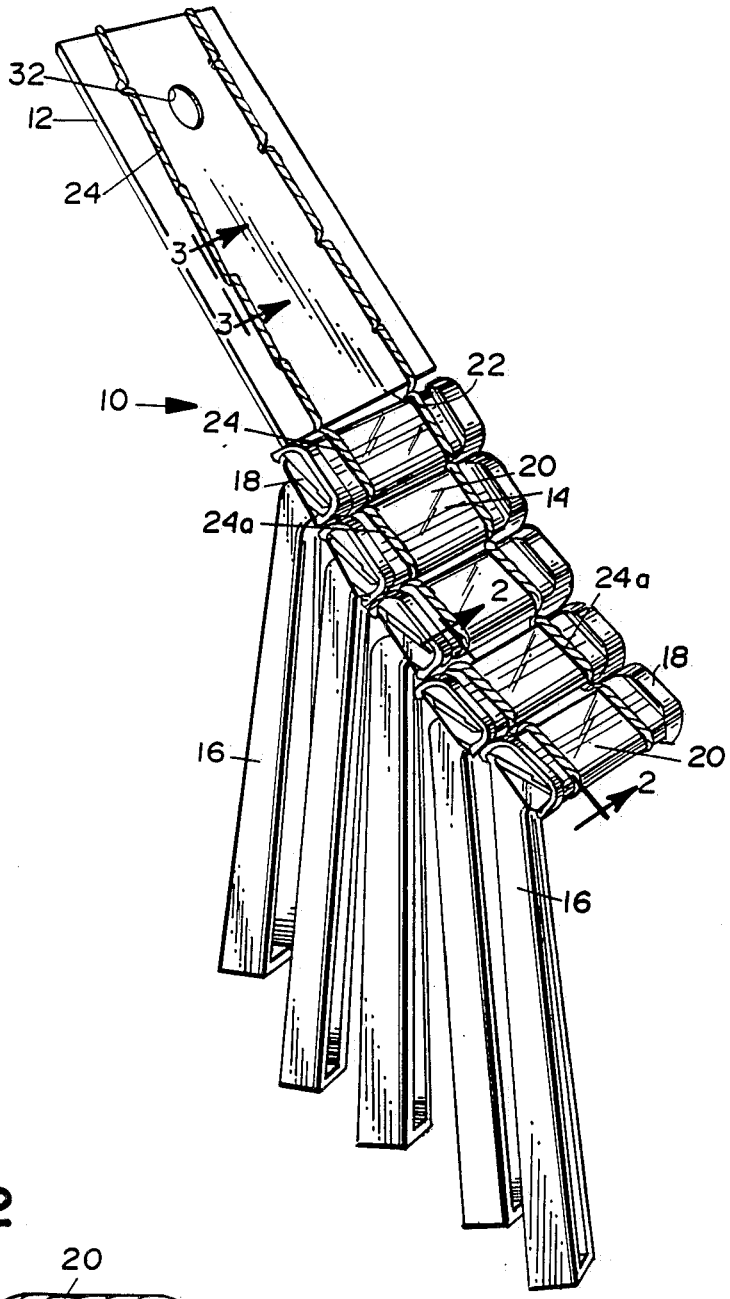
FIG. 1 is a perspective view of a razor package constructed in accordance with the present invention.
Figure 2:
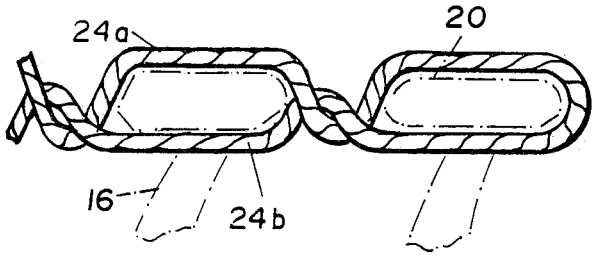
FIG. 2 is an enlarged fragmentary cross-sectional view thereof taken generally about on line 2—2 in FIG. 1.

Referring now to the drawings, particularly to FIG. 1, there is illustrated razor packaging constructed in accordance with the present invention and generally designated 10. Packaging 10 comprises a tag 12 and a plurality of razors 14 secured to tag 12. As illustrated in FIG. 1. each razor 14 has a handle 16 and a razor head 18 with a generally channel-shaped cap 20 overlying the head covering the blade or blades of the razor head 18. It will be appreciated that the construction of the razors, including their handles, heads and caps, is conventional and per se forms no part of the present invention. Suffice to say, however, that the shape of the handles and heads are complementary such that, when aligned in the razor packaging hereof, the handles and heads nest against one another.

Figure 3:
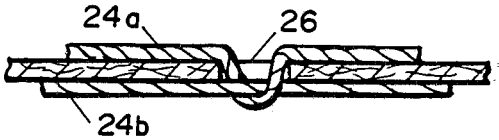
FIG. 3 is an enlarged fragmentary cross-sectional view thereof taken about on line 3—3 in FIG. 1 and illustrating the stitching through the tag.

In accordance with the present invention, the razors are serially and linearly aligned one with the other in the nesting relation substantially as illustrated in FIG. 1 with the uppermost razor, as illustrated, being connected to tag 12 along its lowermost discrete edge 22. Razors 14 are joined one to the other in serial and linearly extending relation by a pair of threads 24. Threads 24 join adjacent razor heads one to the other along each of the upper and lower surfaces thereof along opposite sides of the razor heads from handle 14. Each thread 24 is stitched to tag 12 and, as illustrated in FIG. 3, has upper and lower thread portions **24*a* and 24*b*, respectively. Thus, for example, in tag 12, the upper thread portion 24 is disposed through an aperture 26 in tag 12 and looped about lower thread portion 24*b* to reemerge through the aperture 26 and extend along the upper face of tag 12. This type of stitching is, of course, repeate throughout the length of tag 12. The distal ends of the threads lie at the upper end of tag 12**.

Threads 24 are disposed about razor heads 18 and caps 20 thereon in similar fashion. Particularly, the upper portion **24*a* of each thread 24 extends between each adjacent pair of razor heads 18 and is looped about the corresponding lower thread portion 24*b*. The looped portion then reemerges between the same adjacent pair of razor heads 18 for extension over the cap 20 on the next razor head. Looping of the thread portions is then repeated between the next adjacent pair of razor heads. At the last of the razor heads, the lowermost one illustrated in FIG. 1, each upper thread portion 24*a* extends around its distal edge and becomes the lower thread portions 24*b***.

By stitching the two threads to tag 12 and extending thread portions **24*a* and 24*b* around the razor heads on each of the opposite sides of handles 16, not only is displacement of the razor heads away from one another precluded, but lateral displacement of the razors relative to one another is also precluded. That is to say, because of the looping action of the upper and lower thread portions and about the razor heads on opposite sides of the handle, the razor heads, including caps 20**, are precluded from endwise lateral displacement relative to one another. Note also that the tops of the razor heads lie in a single plane parallel with a plane containing the lower surfaces of the razor heads. Thus, in this arrangement, the razor heads are linearly aligned and serially connected one to the other.

It will be appreciated that suitable indicia may be placed on tag 12. As illustrated, an aperture 32 is formed adjacent the upper end of tag 12 whereby the tag may be disposed on a hook, for example, on a standard display board, with the razors depending therefrom. The tag is preferably formed of paperboard, although other material, such as plastic, may be used as desired. Also, conventional thread, either natural or synthetic fibers, a plastic line or adhesive strip may be used to form the threads 24.

Figure 4:
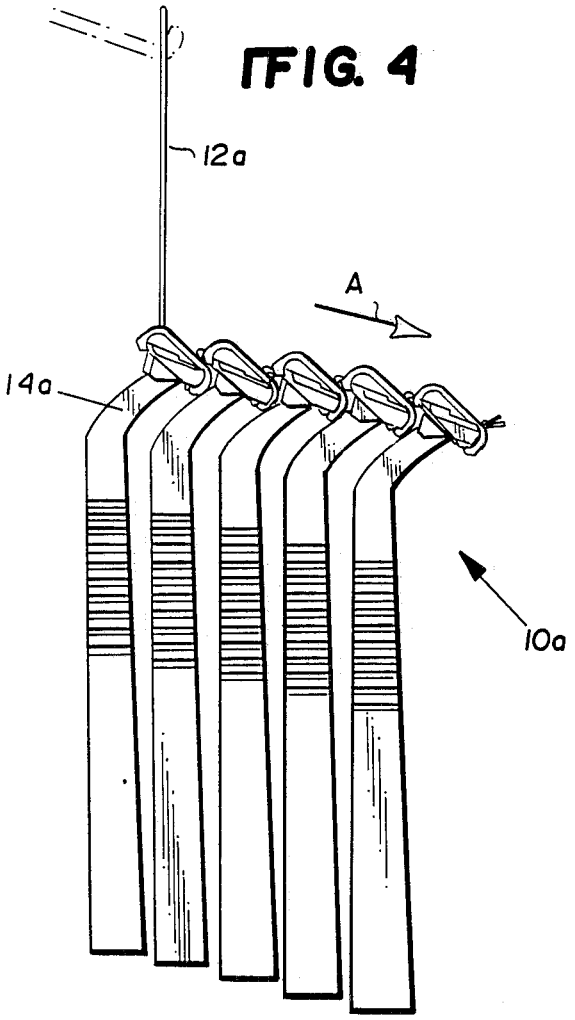
FIG. 4 is a side elevational view of a razor package constructed in accordance with another embodiment of the present invention.
Figure 5:
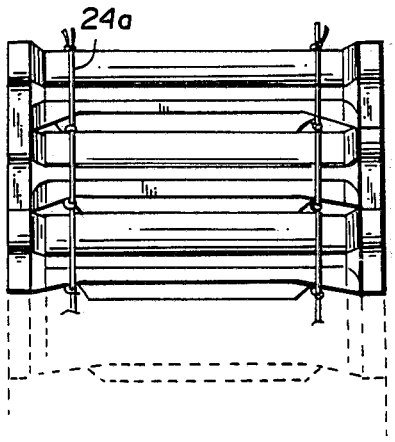
FIG. 5 is a view of the razor package illustrated in FIG. 4 looking along the heads of the group razors in the direction of the arrow A.

Referring now to the embodiment hereof illustrated in FIGS. 4 through 10, wherein like parts have like reference numerals followed by the suffix a, there is illustrated razor packaging **10*a*, comprised of a tag 12*a* and a plurality of razors 14*a* secured to tag 12*a*. The razors 14*a* are conventional in construction and are the same razors illustrated with respect to the previous embodiment. In this embodiment, however, instead of the serial linear alignment of the razors of each package, the razor heads are stepped in relation to one another. This enables a much tighter package of razors because portions of the covers of one razor engage portions of the cover of the adjacent razor, while portions of such adjacent razor engage a handle portion of the one razor. Additionally, this type of stepped packaging of the razor heads enables the package to project at a sharper angle forwardly from the tag 12*a* when the package is hung from a display rack hook as compared with the previously described packaging, thereby conserving display space and enabling additional razor packages to be displayed in the same space as used by the previous packaging. Also, the cross-sectional configuration of the stepped arrangement of razor packaging illustrated in FIGS. 4 through 10** form a generally rectilinear configuration, i.e., approximate a rectangular elevational configuration, as illustrated in FIG. 4. As pointed out hereinafter, this facilitates packaging of the groups of razor packages in a rectangularly-shaped container.

Razors 14a, similarly as in the previous embodiment, are joined one to the other by a pair of threads 24a, albeit here in stepped relation one to the other. Threads 24a join adjacent razor heads one to the other along each of the upper and lower surfaces thereof and along the opposite sides of the razor heads from handles 14a. Each thread 24a is stitched to tag 12a and has upper and lower thread portions, respectively. The arrangement of the threads along the razor heads is similar to the threads of the previous embodiment and further description thereof is not believed necessary.

Figure 6:
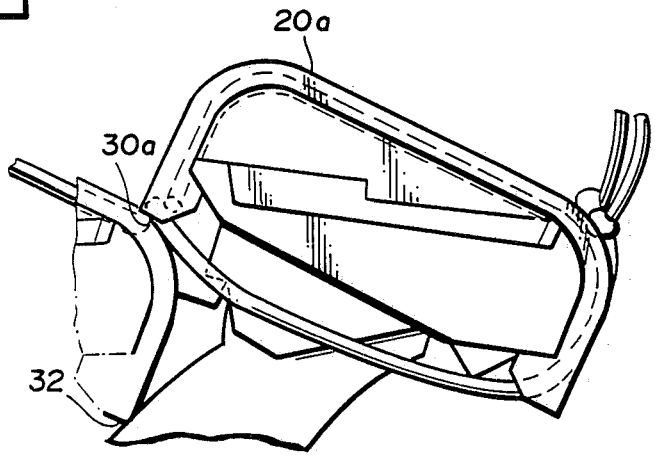
FIG. 6 is an enlarged fragmentary end elevational view of next adjacent serially arranged razor heads illustrating the contact therebetween.

Referring to FIG. 6, it will be seen that the channel-shaped caps 20a have projections at each of their opposite ends and on opposite sides of the razor heads which extend below the plane containing the underside of the razor head. These projections 30a, when the razor heads are serially aligned in stepped relation as illustrated, bear against the upper side of the cap 20a of the next preceding razor head. It will also be appreciated from a review of FIG. 6 that the intermediately indented edge of the cap of the preceding razor head bears against the rear side of the handle of succeeding razor. Thus, next adjacent serially connected razor heads have a three-point contact with one another, thereby stabilizing the razor package. That is to say, the rear edge of each razor head, beyond the first razor head connected to tag 12a, lies preferably above the forward edge of the preceding razor head. Thus, the opposite ends of the rear side of each cap (except the cap of the first razor head) bears against the opposite upper end portions of the preceding cap and its handle bears against an intermediate edge of the cap of the preceding razor. Thus, the razor heads are mounted in stepped relation one to the other.

In this form, the threads which extend along one side of the package, i.e., the upper sides of the razor heads, are looped about the threads which extend along the lower side of the razor heads. Alternatively, the threads could be knotted at each of those locations, as illustrated in FIG. 7.

Figure 10:
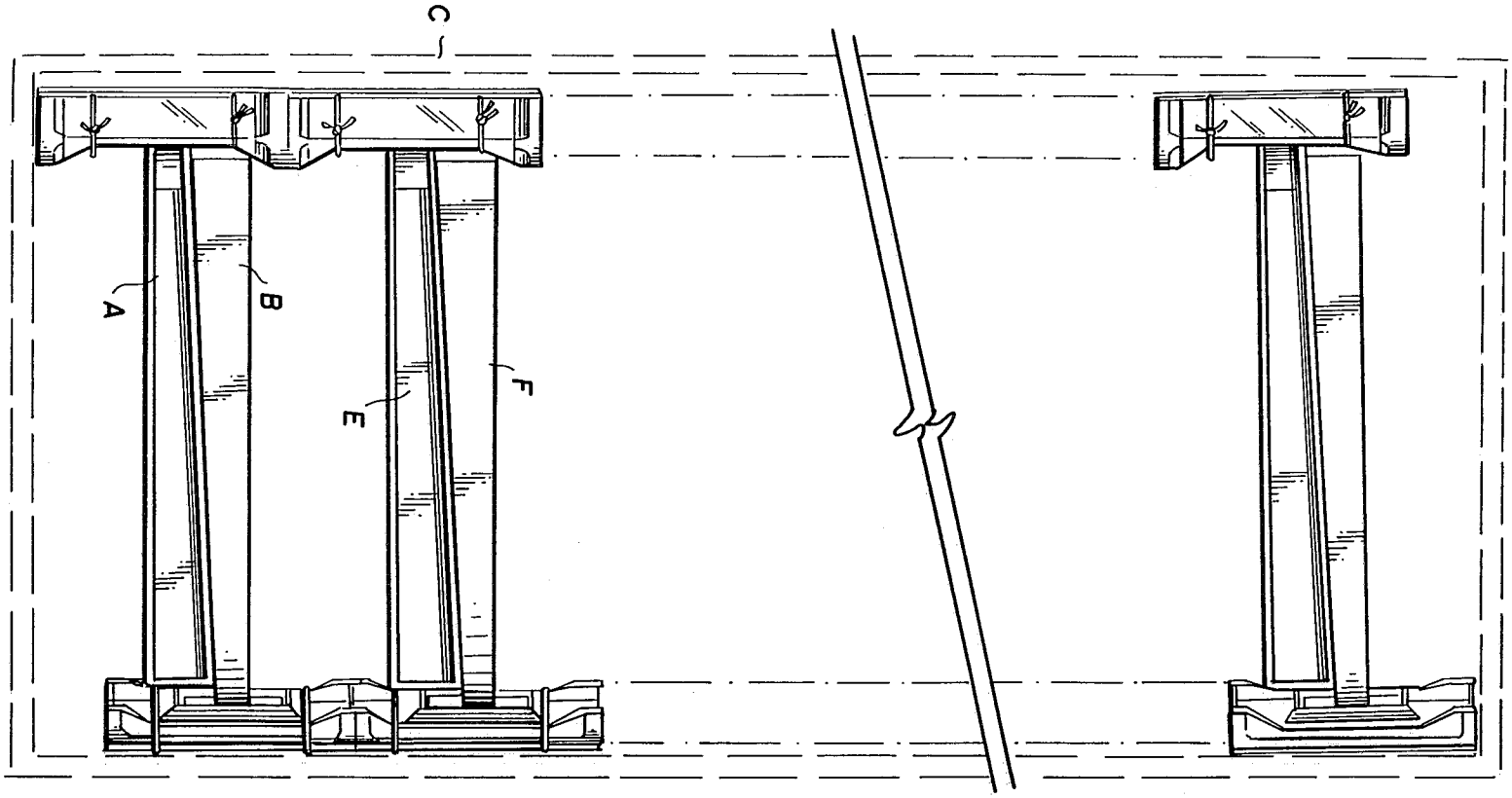
FIG. 10 is a plan view of a rectangular container containing a plurality of razor packages grouped as in FIG. 9 within the container.

Referring to FIG. 9, a pair of the razor packages 10a illustrated in FIG. 4 are disposed in side-by-side relation one to the other, for example, for packaging in a generally rectilinear container designated C in FIG. 10. In FIG. 9, the razor package designated A is disposed adjacent the razor package designated B. The tags 12a of each razor package A and B are pivoted to extend along the upper sides of the razor heads of the respective packages. The packages A and B are disposed such that the razor heads lie at opposite ends, with the handles laterally engaging one another. Thus, as illustrated in FIG. 9, the razor heads of the package A lie at the opposite end of the combined packages A and B from the razor heads of the package B. With the tags 12a thus folded over the respective razor heads, a generally rectilinear or approximate rectangular cross-sectional configuration obtains, as illustrated in FIG. 9. Packages A and B may be secured one to the other in this configuration, as desired, for example by string, adhesive tape or the like.

Groups of packages, similarly arranged as packages A and B, may be disposed in the generally rectangular carton C illustrated in FIG. 10, with the packages lying side-by-side one to the other. Thus, the packages A and B may be disposed in the end of the carton C and similar packages E and F may be disposed such that the razor heads of the package A lie in endwise relation to the razor heads of package E. Similarly, the razor heads of packaging D lie in endwise relation to the razor heads of package F. Thus, carton C may be filled lengthwise with groups of packages oriented as described and illustrated. This facilitates automated packaging procedures and substantially fills the volume of the carton C. The packages A and B, E and F and other paired packages may be secured one to the other if desired, for example, by threading or adhesive tape. However, the packaging of razors in the manner disclosed may be provided without positively securing the individual packages, i.e., packages A and B, one to the other or the groups of such paired packages to one another.

Consequently, it will be appreciated that the objects of the present invention are fully accomplished in that there has been provided novel and improved packaging for razors in a manner to facilitate their display in a space-saving manner, as well as to maintain plural razors in an integral coherent group, i.e., as a single entity or unit, which may not be disassembled without cutting the threads. The integrity and stability of the package are also enhanced by engaging adjacent razor heads one against the other at endwise spaced locations and engaging the neck of one razor handle with the adjacent razor head. Also, the protective caps on the razor heads are maintained in place by the threads in their position secured on the razor heads.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Razor packaging comprising a plurality of razors, each of said razors having a razor head with elongated forward and rear edges and a handle projecting from the head;

a display tag; and means for serially connecting said razors one to the other and to said tag, said tag being connected to one of said razors with the rear edge of each razor head beyond said one razor in a direction away from said tag lying above or below the forward edge of the preceding razor head whereby said razor heads lie in stepped relation one to the other.

2. Packaging according to claim 1 wherein the rear edge of each of said razor heads beyond said one razor in a direction away from said tag lies above the forward edge of the preceding razor head.

3. Packaging according to claim 2 wherein each of said razor heads carries a protective cap having forward and rear edges, the rear edge of each cap carried by the razor heads beyond said one razor in a direction away from said tag lying above the forward edge of the cap carried by the preceding razor head.

4. Packaging according to claim 3 wherein the forward edge of the cap of each preceding razor head including said one razor head engages the handle of the following razor.

5. Packaging according to claim 1 wherein said serial connecting means connects said razor heads one to the other and includes a thread stitched through said tag and disposed about said razor heads.

6. Packaging according to claim 5 wherein the rear edge of each of said razor heads beyond said one razor in a direction away from said tag lies above the forward edge of the preceding razor head.

7. Packaging according to claim 6 including a second thread stitched to said tag and disposed about said razor heads for connecting said razors one to the other and to said tag, said handles projecting from said heads at locations substantially medially of the lengths thereof, the threads being disposed about each said razor head on opposite sides thereof relative to said handle.

8. Packaging according to claim 7 wherein each of said razor heads carries a protective cap having forward and rear edges, the rear edge of each cap carried by the razor heads beyond said one razor in a direction away from said tag lying above the forward edge of the cap carried by the preceding razor head, said threads being disposed about each of said caps.

9. Packaging according to claim 8 wherein said one razor constitutes the end razor of said serially connected razors, said tag being elongated and connected to said one razor by said threads adjacent one end thereof.

10. Packaging according to claim 8 wherein said tag has a discrete edge, said razors being connected to said tag along said discrete edge thereof, said tag being formed at least in part of paperboard.

11. Razor packaging, comprising:

a plurality of razors, each of said razors having a razor head and a handle projecting from the head;

a display tag having a discrete edge; and means for serillly connecting said razors one to the other and to said tag along said discrete tag edge to form a package of razors, an edge of one razor overlying an edge of the next adjacent serially connected razor in said package of razors.

12. Packaging according to claim 11 wherein each of said razor heads has a length greater than its width, said razor heads being connected serially one to the other with the long sides of adjacent razor heads adjoining one another.

13. Packaging according to claim 12 wherein said razor heads are elongated with said handles projecting from said heads at a location substantially medially of the length thereof, said connecting means connecting each said razor head on opposite sides thereof relative to said handle.

14. Packaging according to claim 12 wherein each of said razor heads has a protective cap mounted thereon, said connecting means being disposed on each said razor head to maintain said cap on said razor head.

15. An assemblage of razors comprising:

a plurality of razor packages;

each said razor package including a plurality of razors and a display tag, each said razor including a razor head and a handle projecting from said head;

each said razor package further including means for connecting said razors one to the other and to said tag comprised of a thread stitched through said tag and disposed about said razor heads, said handles of each said package projecting to like sides of the heads of said package;

first and second of said packages being disposed adjacent one another to form an assemblage thereof with the heads of the razors of first and second packages lying at opposite ends of the assemblage and their respective handles extending therefrom in opposite directions toward the heads of the other package.

16. An assemblage according to claim 15 including third and fourth of said packages being disposed adjacent one another to form an assemblage thereof with the heads of the razors of said third and fourth packages lying at opposite ends of the assemblage thereof and their respective handles extending therefrom in opposite directions toward the heads of the other package, said third and fourth packages being disposed adjacent said first and second packages such that the ends of the razor heads of the second and fourth packages and the ends of the first and third packages abut one another, respectively.

17. In combination with the assemblages of claim 15, a generally rectangular container for receiving said assemblages and having opposite generally parallel sides, said assemblages being received in said container with top portions of said razor heads of said first and third packages thereof lying generally parallel to one side of said container and the top portions of said razor heads of said second and fourth packages thereof lying generally parallel to the opposite side of said container.

* * * * *